US007361966B2

(12) United States Patent
Young et al.

(10) Patent No.: US 7,361,966 B2
(45) Date of Patent: Apr. 22, 2008

(54) ACTUATOR CHIP FOR INKJET PRINTHEAD WITH ELECTROSTATIC DISCHARGE PROTECTION

(75) Inventors: Jason K. Young, Lexington, KY (US); Nicole M. Rodriguez, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/352,794

(22) Filed: Feb. 13, 2006

(65) Prior Publication Data

US 2007/0188540 A1 Aug. 16, 2007

(51) Int. Cl.
*H01L 29/00* (2006.01)

(52) U.S. Cl. ..... 257/499; 438/23; 438/40; 438/48

(58) Field of Classification Search ..... 257/499; 437/23, 40, 48

See application file for complete search history.

(56) References Cited

U.S. PATENT DOCUMENTS

| | | | | |
|---|---|---|---|---|
| 3,524,408 A | | 8/1970 | Pierson | |
| 5,147,141 A | * | 9/1992 | Sakaida et al. | 400/124.16 |
| 5,315,472 A | | 5/1994 | Fong et al. | |
| 5,359,211 A | * | 10/1994 | Croft | 257/173 |
| 5,371,395 A | * | 12/1994 | Hawkins | 257/361 |
| 5,428,498 A | * | 6/1995 | Hawkins et al. | 361/212 |
| 5,465,189 A | | 11/1995 | Polgreen et al. | |
| 5,532,901 A | | 7/1996 | Hawkins et al. | |
| 5,610,790 A | * | 3/1997 | Staab et al. | 361/56 |
| 5,710,689 A | | 1/1998 | Becerra et al. | |
| 5,719,739 A | | 2/1998 | Horiguchi | |
| 5,744,841 A | | 4/1998 | Gilbert et al. | |
| 5,892,524 A | * | 4/1999 | Silverbrook | 347/15 |

(Continued)

FOREIGN PATENT DOCUMENTS

EP 0 590 859 4/1994

(Continued)

OTHER PUBLICATIONS

W.G. Hawkins et al., "Silicon based 40-V thermal ink jet IC" Microelectronic Engineering, vol. 19 (1992) pp. 165-168.*

(Continued)

*Primary Examiner*—Jerome Jackson
*Assistant Examiner*—Jami Valentine
(74) *Attorney, Agent, or Firm*—King & Schickli, PLLC

(57) ABSTRACT

An inkjet printhead chip includes electrostatic discharge (ESD) circuits to protect the chip during ESD events, including one preventing a thin dielectric layer on a substrate from breakdown. In one embodiment, the chip includes an ESD circuit essentially dedicated per each actuator. In another, ESD circuits alternate connection between power and ground. In still another, actuators are approximately equidistantly spaced regarding respective ESD circuits. Exemplary ESD circuits include a ballast resistor in series with a diode. In turn, diodes are either forward biased toward power or away from ground. In a thermal inkjet embodiment, a cavitation layer above a resistor and dielectric layer have pluralities of fingers connecting the cavitation layer to a metal buss. The metal buss attaches to the ballast resistors. Protection typically embodies the safe distribution of ESD current to ground during both chip manufacture and user printhead installation. Inkjet printheads and printers are also disclosed.

13 Claims, 7 Drawing Sheets

U.S. PATENT DOCUMENTS

| | | | | |
|---|---|---|---|---|
| 5,960,290 | A | 9/1999 | Hsu | |
| 5,988,796 | A | 11/1999 | Yamanaka | |
| 6,248,639 | B1 | 6/2001 | Ravanelli | |
| 6,278,585 | B1 * | 8/2001 | Olson et al. | 360/264.2 |
| 6,361,150 | B1 * | 3/2002 | Schulte et al. | 347/56 |
| 6,454,955 | B1 | 9/2002 | Beerling et al. | |
| 6,493,198 | B1 | 12/2002 | Arledge et al. | |
| 6,567,251 | B1 | 5/2003 | Schulte et al. | |
| 6,576,959 | B2 | 6/2003 | Kunz et al. | |
| 6,692,111 | B2 | 2/2004 | Beerling et al. | |
| 6,764,892 | B2 | 7/2004 | Kunz et al. | |
| 2004/0079744 | A1 | 4/2004 | Bodeau et al. | |
| 2004/0100746 | A1 | 5/2004 | Chen et al. | |
| 2004/0183866 | A1 * | 9/2004 | Conta et al. | 347/65 |
| 2004/0207693 | A1 | 10/2004 | Sturgeon et al. | |
| 2004/0212936 | A1 | 10/2004 | Salling et al. | |
| 2005/0012791 | A1 * | 1/2005 | Anderson et al. | 347/85 |

FOREIGN PATENT DOCUMENTS

| | | |
|---|---|---|
| JP | 04-247947 | 9/1992 |
| JP | 08-039801 | 2/1996 |
| JP | 08-132616 | 5/1996 |
| JP | 2003-072076 | 3/2003 |
| JP | 2004-050636 | 2/2004 |

OTHER PUBLICATIONS

S. Gibilisco, The Illustrated Dictionary of Electronics—8th edition, New York: McGraw-Hill, 2001, p. 60.*

* cited by examiner

ACTUATOR CHIP FOR INKJET PRINTHEAD WITH ELECTROSTATIC DISCHARGE PROTECTION

FIELD OF THE INVENTION

The present invention relates to inkjet printheads. In particular, it relates to an actuator chip having electrostatic discharge (ESD) protection.

BACKGROUND OF THE INVENTION

The art of printing images with inkjet technology is relatively well known. In general, an image is produced by emitting ink drops from a printhead at precise moments so they impact a print medium at a desired location. In a scanning-head embodiment, the printhead is supported by a movable print carriage within a device, such as an inkjet printer, and is caused to reciprocate relative to an advancing print medium. It emits ink at times pursuant to commands of a microprocessor or other controller. The timing of the emissions corresponds to a pattern of pixels of the image being printed. Other than printers, familiar devices incorporating inkjet technology include fax machines, all-in-ones, photo printers, and graphics plotters, to name a few.

Conventionally, a thermal inkjet printhead includes access to a local or remote supply of color or black ink, a heater chip, a nozzle plate attached to or integrated with the heater chip, and an input/output connector, such as a tape automated bond (TAB) circuit, for electrically connecting the heater chip to the printer during use. The heater chip, in turn, typically includes a plurality of thin film resistors (also referred to as "heaters") fabricated by deposition, patterning and etching on a substrate such as silicon. One or more ink vias cut or etched through a thickness of the substrate serve to fluidly connect the supply of ink to the individual heaters.

Heretofore, conventional heater chip thin films included a relatively thick silicon nitride (SiN) and/or silicon carbide (SiC) layer(s) overlying a resistor layer for reasons relating to passivation. In turn, a cavitation layer lied over the two passivation layers to protect the heater from corrosive ink and bubble collapse occurring in the ink chamber. However, as layers continued to become thinner and more energy efficient over time, thinner passivation seemed unable to provide adequate ESD protection. It some instances, the passivation has been so thin that ESD events damage the resistor layer making it altogether inoperable.

Accordingly, the inkjet printhead arts desire ESD protection despite a continuing trend toward thinner chip configurations.

Appreciating some advances in ESD protection have occurred over time, some prior art products use a serpentine resistive structure at a terminal end of the cavitation layer, for example, to dissipate current of ESD events. However, a disparity exists between heaters closest to the serpentine structure and those farther away. As expected, the closest ones are afforded better ESD protection than the farther ones.

Appreciating ESD events can occur during use, handling and/or manufacturing, other prior art devices contemplate ESD structures for each of the various phases. Namely, some prior art teachings use fuses separating active from inactive components during manufacturing and teach using other structures during use. However, these approaches add undesirable complexity. For example, using devices that are not practically reset able, like conventional fuses and/or preferred breakdown locations, can obviously limit the functionality of such circuits (once triggered, the device cannot be readily reset). Accordingly, alternative circuits might be provided for to address scenarios that might arise after the aforementioned devices are triggered, leading to more complexity.

Further, because ESD protection is often implemented by a single element, such as the serpentine resistive structure or fuse, very little, if any, robustness can be obtained. That is, ESD current dissipation is often limited to a few milliamps. However, many actual ESD events surpass this minimal current dissipation criterion and chips touting ESD protection are routinely destroyed by ESD.

Accordingly, the present inventors have determined that the inkjet printhead arts desire improvements in ESD protection that afford common or similar protection for an entire chip and not for a few select actuators closest to the ESD protection structure. Protection should also be made available for a chip at all times, including use, handling and manufacture, and should be simple in implementation. ESD current dissipation should also contemplate amperage well above the milliamp range. Naturally, any improvements in ESD protection should further contemplate good engineering practices, such as relative inexpensiveness, low power consumption, ease of manufacturing, etc.

SUMMARY OF THE INVENTION

The above-mentioned and other problems can be solved by applying the principles and teachings associated with the hereinafter described inkjet printhead actuator chip having ESD protection. Among other things, an exemplary embodiment of the present invention affords ESD protection on an approximate one-to-one relationship or correspondence with each actuator of the chip. In this manner, each actuator has nearly dedicated ESD protection, unlike the prior art. In an exemplary embodiment, substantial equidistance also exists between each actuator and its respective ESD protection, thereby affording similar protection to each actuator.

In one embodiment of the invention, an actuator chip includes pluralities of thin film layers on a substrate forming pluralities of actuators. For example, a resistor layer can reside on the substrate with a dielectric layer on the resistor layer, and a cavitation layer on the dielectric layer. (Naturally, intervening layers are possible). ESD protection can be provided by an ESD circuit, one per each actuator, such as a circuit including a ballast resistor in series with a diode. A conductive metal buss can be connected to each ballast resistor on one side and to pluralities of fingers of the cavitation layer, extending from a large mass of the cavitation layer, on another side. In an exemplary embodiment, forward biasing of the diode toward power or away from ground occurs for alternating ones of the ESD circuits and, during ESD events, the ballast resistor and diode conduct to safely discharge ESD current away from the dielectric layer. As such an ESD circuit is an active device that turns on during an ESD event and turns off during normal operation, it provides for a safe distribution of ESD current, without necessarily requiring anything to be reset or alternative ESD circuits. The safe distribution of ESD current affords protection during both chip manufacturing and user printhead installation.

In another aspect, each ESD circuit is approximately equidistantly spaced with respect to a respective actuator. In this manner, each actuator is afforded ESD protection comparable to every other actuator. Also, because of the synergy available to dissipate current, ESD current can be dissipated with approximately a tenfold increase over some prior art devices.

In other embodiments, a dielectric layer on a resistor layer has a relatively thin layer thickness on the order of about 2000 Angstroms. Compositions making up the dielectric layer might include diamond like carbon, including various dopants, or more traditional silicon nitride and/or silicon carbide compositions.

In still other aspects of the invention, inkjet printheads containing such actuator chips and printers containing such printheads are disclosed.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION OF EXEMPLARY EMBODIMENTS

In the following detailed description of exemplary embodiments, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized and that process, electrical or mechanical changes may be made without departing from the scope of the present invention. The term wafer or substrate used in this specification includes, for example, ceramic and silicon substrates. For example, embodiments of the present invention might use silicon-on-sapphire (SOS) technology, silicon-on-insulator (SOI) technology, thin film transistor (TFT) technology, doped and undoped semiconductors, epitaxial layers of silicon supported by a base semiconductor structure, as well as other structures well known to one skilled in the art. The following detailed description is, therefore, not to be taken in a limiting sense, and the scope of the present invention is defined only by the appended claims and their equivalents. In accordance with the present invention, an inkjet printhead actuator chip having ESD protection, including plural ESD circuits, is hereinafter described.

Figure 1:
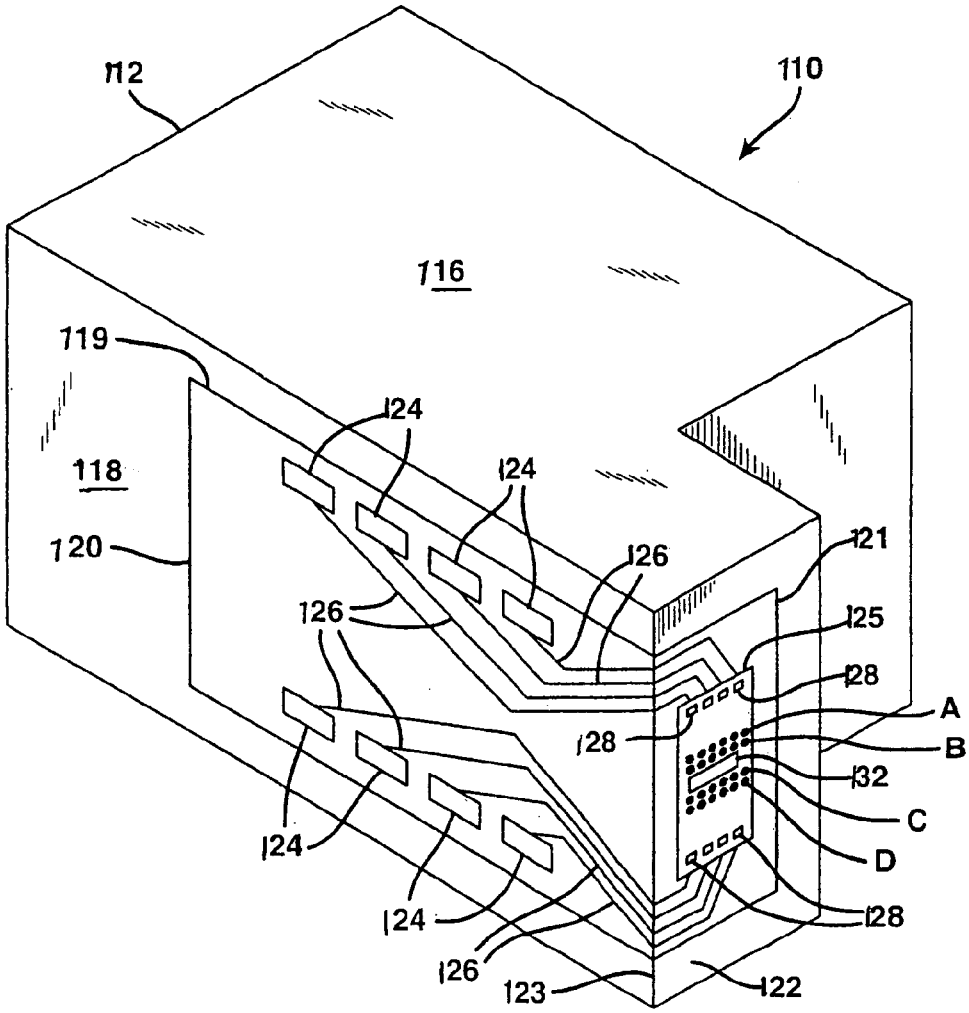
FIG. 1 is a perspective view in accordance with the teachings of the present invention of an inkjet printhead and heater chip having ESD protection.

With reference to FIG. 1, an exemplary inkjet printhead is shown generally as 110. The printhead 110 has a housing 112 having a shape that often depends upon the external device that carries or contains it. The housing has at least one compartment 116, internal thereto, for holding an initial or refillable supply of ink. In one embodiment, the compartment has a single chamber and holds a supply of either black ink, cyan ink, magenta ink or yellow ink. In other embodiments, it has multiple chambers and contains supplies of three different inks. In one instance, it includes supplies of cyan, magenta and yellow ink. In still other embodiments, the compartment contains plurals of black, cyan, magenta and/or yellow ink. It will be appreciated, however, that while the compartment 116 is shown as locally integrated within a housing 112 of the printhead, it may alternatively be remote and/or separable from the housing 112 and/or printhead 110, for example.

Adhered to one surface 118 of the housing 112 is a portion 119 of a flexible circuit, especially a tape automated bond (TAB) circuit 120. The other portion 121 is adhered to another surface 122 of the housing. In this embodiment, the two surfaces 118, 122 are arranged perpendicularly to one another about an edge 123 of the housing.

The TAB circuit 120 supports a plurality of input/output (I/O) connectors 124 thereon for electrically connecting an actuator chip, such as heater chip 125, to an external device, such as a printer, fax machine, copier, photo-printer, plotter, all-in-one, etc., during use. Pluralities of electrical conductors 126 exist on the TAB circuit to electrically connect and short the I/O connectors 124 to the input terminals (bond pads 128) of the heater chip 125 and skilled artisans know various techniques for facilitating this. In an exemplary embodiment, the TAB circuit is a polyimide material and the electrical conductors and connectors comprise copper. For simplicity, FIG. 1 only shows eight I/O connectors 124, eight electrical conductors 126 and eight bond pads 128 but present day printheads have larger quantities and any number is equally embraced herein. Also, those skilled in the art should appreciate that while such number of connectors, conductors and bond pads equal one another, actual printheads may have unequal numbers.

Figure 7C:
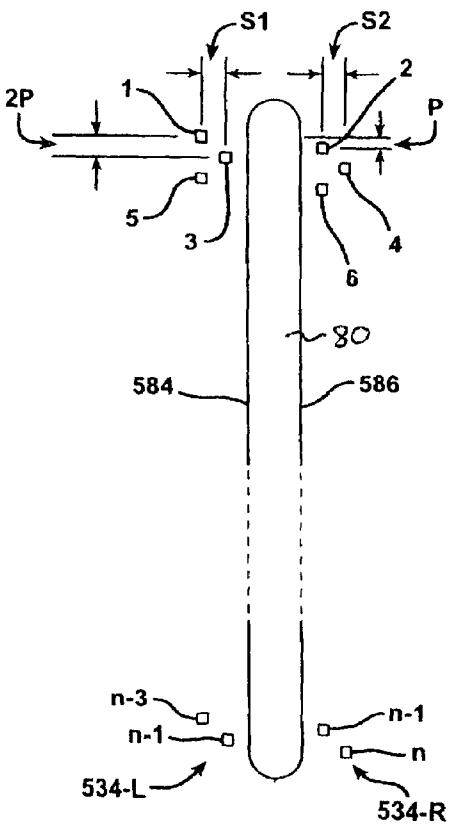
FIGS. 7A-7C are diagrammatic views in accordance with the teachings of the present invention of alternate embodiments of columns of actuators having dedicated ESD protection.
Figure 7B:
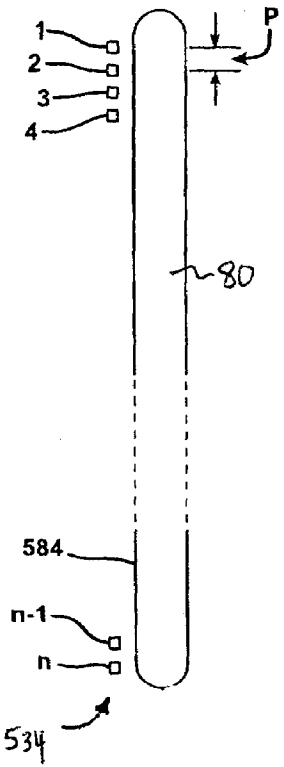
Figure 7A:
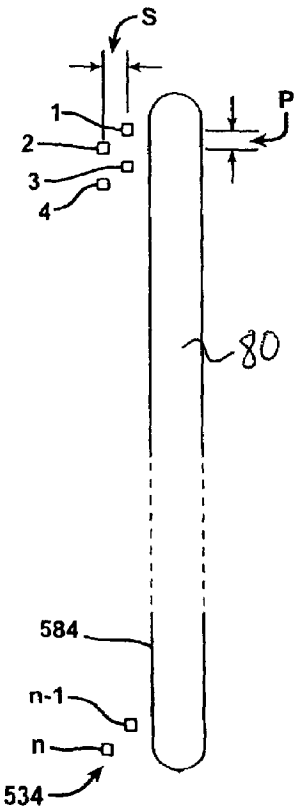

The heater chip 125 contains at least one ink via 132 (alternatively reference numeral 402 or 80 in FIGS. 4 and 7A-7C) that fluidly connects to a supply of ink. During printhead manufacturing, the heater chip 125 is typically attached to the housing with any of a variety of adhesives, epoxies, etc., as is well known in the art. Many processes are known that can cut or etch through a thickness of the heater chip to form a via. Some of the more preferred processes include grit blasting or etching, such as wet, dry, reactive-ion-etching, deep reactive-ion-etching, or the like. To eject ink, the heater chip might contains four columns (column A-column D) of heaters. In other actuator chips, different actuating technologies may be used to cause ejection of ink, such as by using piezoelectric elements, MEMs devices, and the like. For simplicity in this crowded figure, four columns of six dots or darkened circles depict the heaters but in practice the heaters might number several hundred or thousand. Vertically adjacent ones of the heaters may or may not have a lateral spacing gap or stagger there between as shown in FIGS. 7A-7C. In general, however, the heaters have vertical pitch spacing, such as about $1/300^{th}$, $1/600^{th}$, $1/1200^{th}$, or $1/2400^{th}$ of an inch along the longitudinal extent of a via. As described below in greater detail, it is appreciated that the individual heaters of the heater chip can become formed as a series of thin film layers made via growth, deposition, masking, patterning, photolithography and/or etching or other processing steps. A nozzle member, such as a laser-ablated nozzle plate, with pluralities of nozzles (which are sometimes referred to as nozzle holes), not shown, is adhered to, or fabricated as another thin film layer on, the heater chip, such that, in an exemplary embodiment, the nozzle holes generally align with and are positioned above the heaters. In some embodiments, however, it may be advantageous for a heater to be offset from the nozzle, such as to minimize the effects of cavitation from a collapse of a bubble used to eject the ink. During use, the nozzles direct an ejected ink drop towards a print medium.

Figure 2:
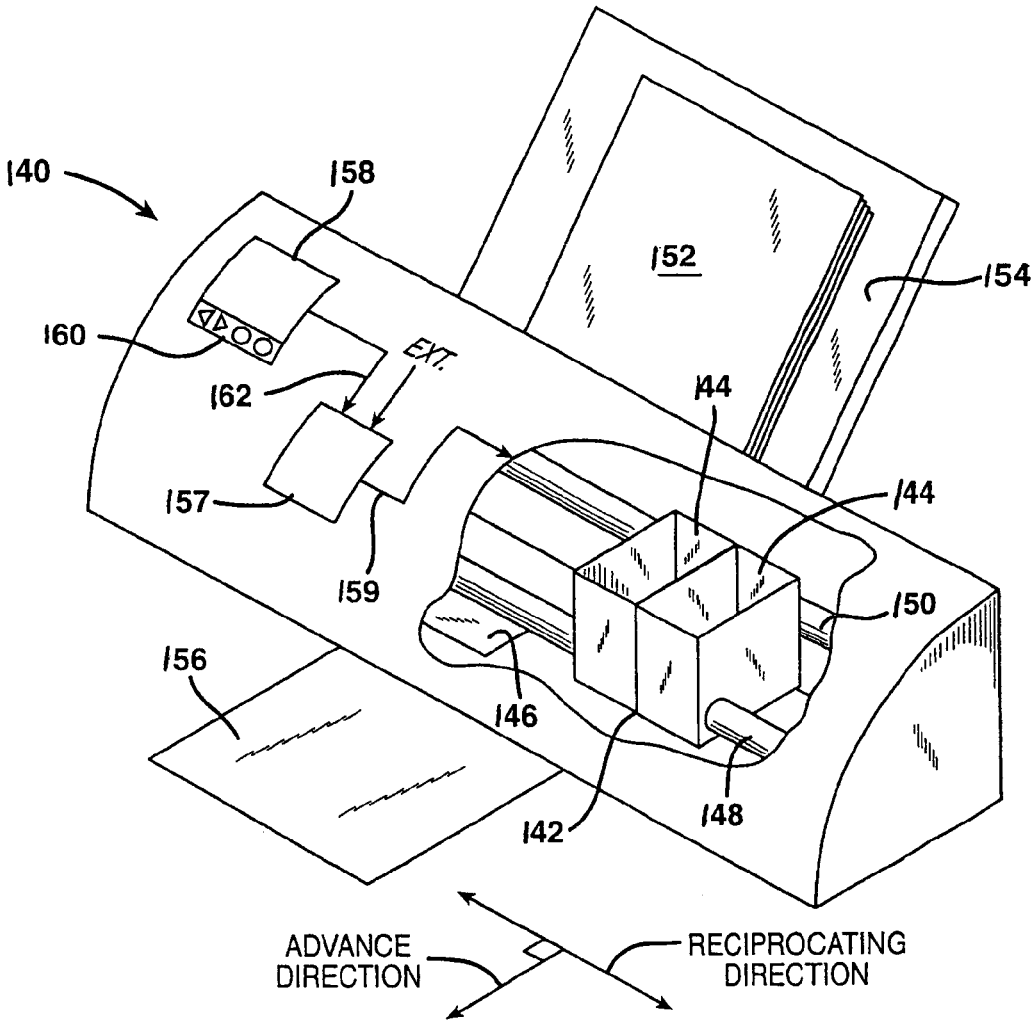
FIG. 2 is a perspective view in accordance with the teachings of the present invention of an exemplary printer for use with the inkjet printhead and heater chip of FIG. 1.

With reference to FIG. 2, an external device in the form of an inkjet printer contains the printhead 110 during use and is shown generally as 140. The printer 140 includes a carriage 142 having a plurality of slots 144 for containing one or more printheads 110. The carriage 142 reciprocates (in accordance with an output 159 of a controller 157) along a shaft 148 above a print zone 146 by a motive force supplied to a drive belt 150 as is well known in the art. The reciprocation of the carriage 142 occurs relative to a print medium, such as a sheet of paper 152, that advances in the printer 140 along a paper path from an input tray 154, through the print zone 146, to an output tray 156.

While in the print zone, the carriage 142 reciprocates in a Reciprocating Direction, which is generally perpendicular to an Advance Direction, which is the direction in which the paper 152 is being advanced (as shown by the arrows). Ink from compartment 116 (FIG. 1) is caused to be ejected in a drop(s) from the heater chip 125 at such times pursuant to commands of a printer microprocessor or other controller 157. The timing of the ink drop emissions corresponds to a pattern of pixels of the image being printed. Often times, such patterns become generated in devices electrically connected to the controller 157 (via Ext. input) that reside external to the printer and can include, but are not limited to, a computer, a scanner, a camera, a visual display unit, a personal data assistant, or other.

To emit a single drop of ink, a heater (e.g., one of the dots in columns A-D, FIG. 1) is provided with a small amount of current (such as through a combination of addressing and pulsing) to rapidly heat a small volume of ink. This causes a portion of the ink to vaporize in a local ink chamber between the heater and the nozzle member, and eject a drop(s) of the ink through a nozzle(s) in the nozzle member towards the print medium. A fire pulse that might be used to provide such a current may comprise a single or a split firing pulse that is received at the heater chip on an input terminal (e.g., bond pad 128) (or decoded at the heater chip) from connections allocated between the bond pad 128, the electrical conductors 126, the I/O connectors 124 and controller 157. Internal heater chip wiring conveys the fire pulse from the input terminal to one or many of the heaters, where it can be used to cause current to flow through such a heater, such as if the heater has also been placed in communication with ground (e.g., via operation of addressing logic/devices). Addressing logic and/or devices may be used to decode an addressing signal(s) transmitted to the heater chip by the external device, possibly in the same manner as, and in coordination with, the fire pulse(s), to cause such current to flow at a desired point in time.

A control panel 158, having user selection interface 160, also accompanies many printers as an input 162 to the controller 157 and provides additional printer capabilities and robustness.

Figure 3:
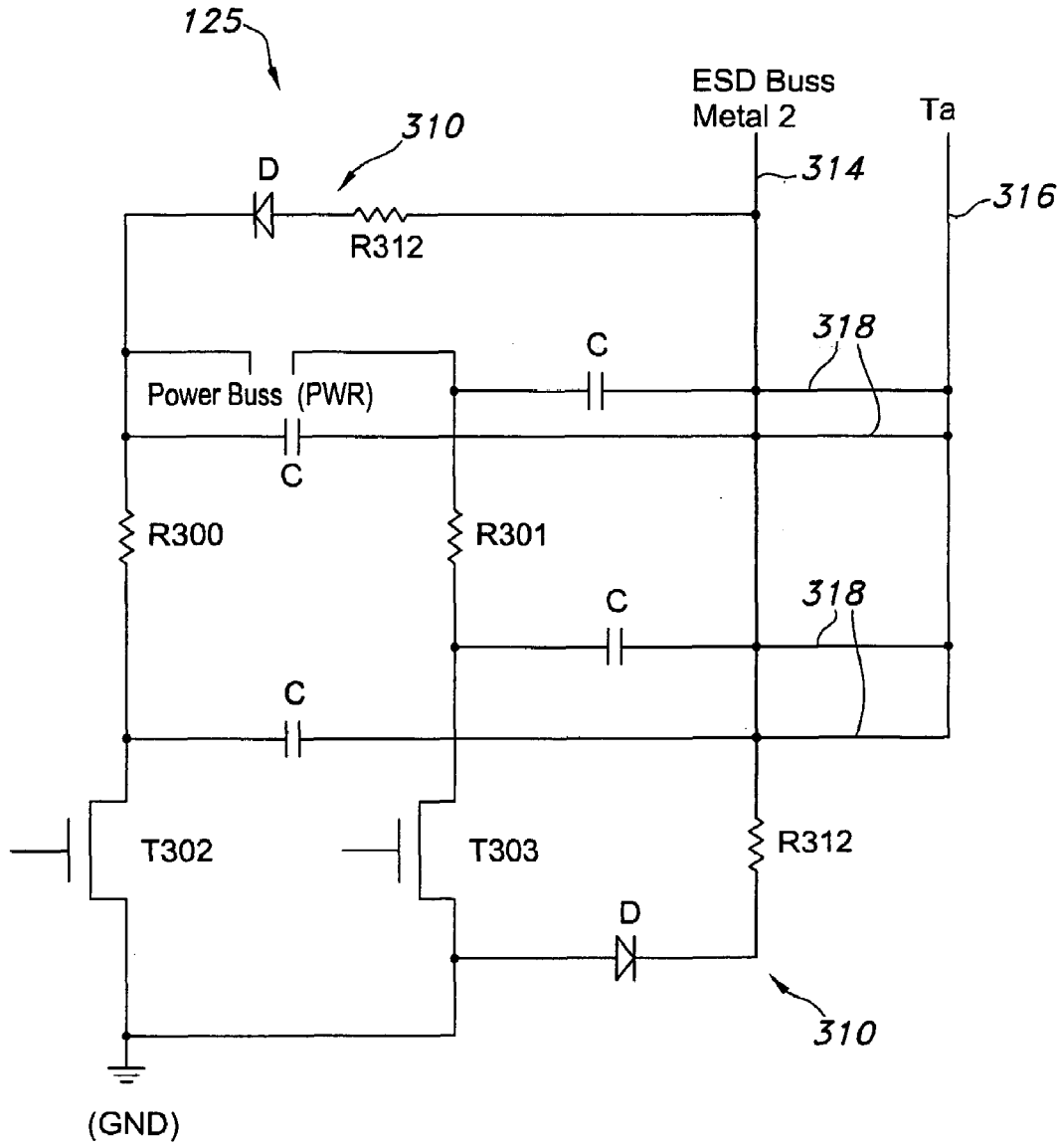
FIG. 3 is a circuit diagram in accordance with the teachings of the present invention of a pair of adjacent heaters in an inkjet printhead heater chip having dedicated ESD protection.

With reference to FIG. 3, an electrical circuit of a portion of the heater chip 125 having ESD protection includes a power buss (PWR) and ground (GND). Two adjacent heaters R300, R301, can be used to eject ink, or not, depending upon activation of a corresponding power FET T302, T303, respectively, and all are well known. However, associated with each heater is an ESD circuit 310 offering ESD protection to the heater comparable to that offered to every other heater on the chip.

In one embodiment, the ESD circuit includes a ballast resistor R312 in series with a diode D. On one end thereof, a metal buss (such as one formed in a second layer of metal on the chip) 314 connects to the ballast resistors. On the other end, the diode connects to either the power buss PWR or ground buss GND. Also, forward biasing of the diode is such that it either conducts towards PWR or away from GND for every adjacent two heaters. A cavitation layer 316 over the heaters, such as a layer of tantalum, is connected to the metal buss 314. For example, a plurality of fingers 318 of tantalum may be extended from a relatively large mass portion 317 of the cavitation layer 316 towards, and connected to, the metal buss 314. In an exemplary embodiment, the number of fingers 318 corresponds to the number of actuators of the heater chip. In this manner, upon occurrence of an ESD event, particularly one in the vicinity of one or more of the heaters, the ESD circuit conducts, and ESD current is safely distributed away from the heater(s), especially a dielectric layer overlying a resistive layer, as will be described in more detail below.

Naturally, other embodiments of the invention contemplate other structures or elements of the ESD circuit that are present in addition to or in replacement for those shown. For example, devices such as a grounded gate nmos transistor, field oxide with or without a control gate, silicon controlled rectifier (SCR), or simply a large capacitor could be used to divert ESD currents away from the cavitation layer. Diodes, however, were chosen in the present embodiment for their small size. Further, skilled artisans will appreciate that these other elements will require alternate connections. Lastly, FIG. 3 diagrammatically depicts various parasitic capacitors C scattered throughout the circuit. These parasitic couplings are especially protected from ESD events.

Figure 4:
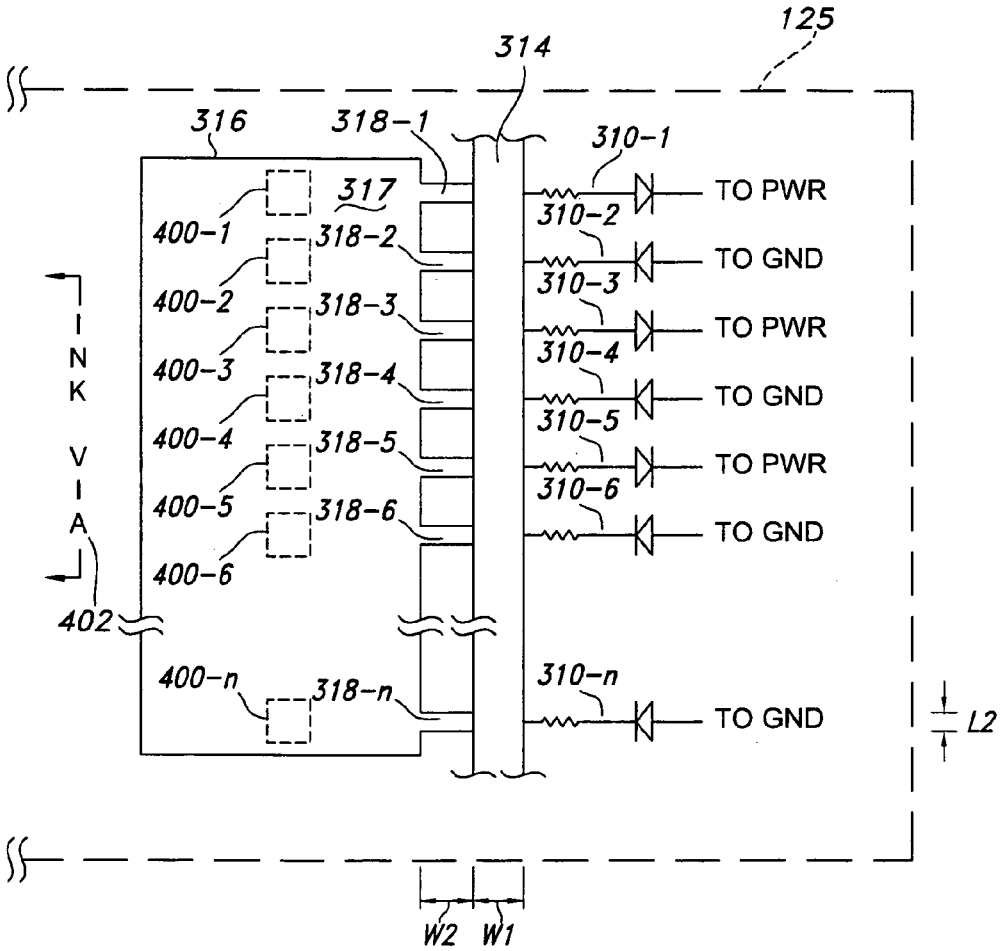
FIG. 4 is a diagrammatic view in accordance with the teachings of the present invention of an inkjet printhead having a distributed network of ESD protection devices.

With reference to FIG. 4, heater chip 125 is given in partial diagrammatic, planar view and partial circuit view. Heater chip 125 includes a plurality of heaters 400 substantially arranged in a column adjacent an ink via 402 to eject ink from the heater chip. The heaters 400 are shown as dashed rectangles to illustrate their position beneath a relatively large mass portion 317 of the cavitation layer 316. Adjacent each heater is a respective ESD circuit 310, the circuits 310 being spaced substantially equidistantly from each respective one of the heaters. The pluralities of fingers 318 that connect the large mass portion 317 of the cavitation layer 316 to the metal buss 314 are also adjacent the heaters 400, and correspond roughly one-to-one with the number of heaters. As before, this affords protection to each heater in a manner comparable to every other heater. Further, because each of the ESD circuits are approximately equidistantly spaced from one another, ESD current dissipation for an entirety of the heater chip is greatly increased. In some instances, a tenfold increase is realized, as will be described below relative to FIG. 6.

With continued reference to FIG. 4, skilled artisans can easily recognize the alternating pattern of an ESD circuit 310-1 connected to power PWR, and an ESD circuit 310-2 connected to ground GND. Also, a longitudinal extent of the metal buss 314 substantially parallels the substantially columnar array of heaters 300. The fingers 318, however, have a longitudinal extent substantially perpendicular to the longitudinal extent of the metal buss 314. Of course, skilled artisans will observe various other proximity of the structures relative to one another and all may serve as advantageous features over the prior art. For instance, each actuator is spaced relatively equidistant with respect to a nearest and/or respective ESD circuit (e.g., actuator 400-1 and 400-4 are relatively the same distance from ESD circuits 310-1 and 310-4, respectively). This finds advantage over the prior art because ESD protection commonality for an entire chip is achieved whereas heretofore it did not exist.

Figures 5A, 5B:
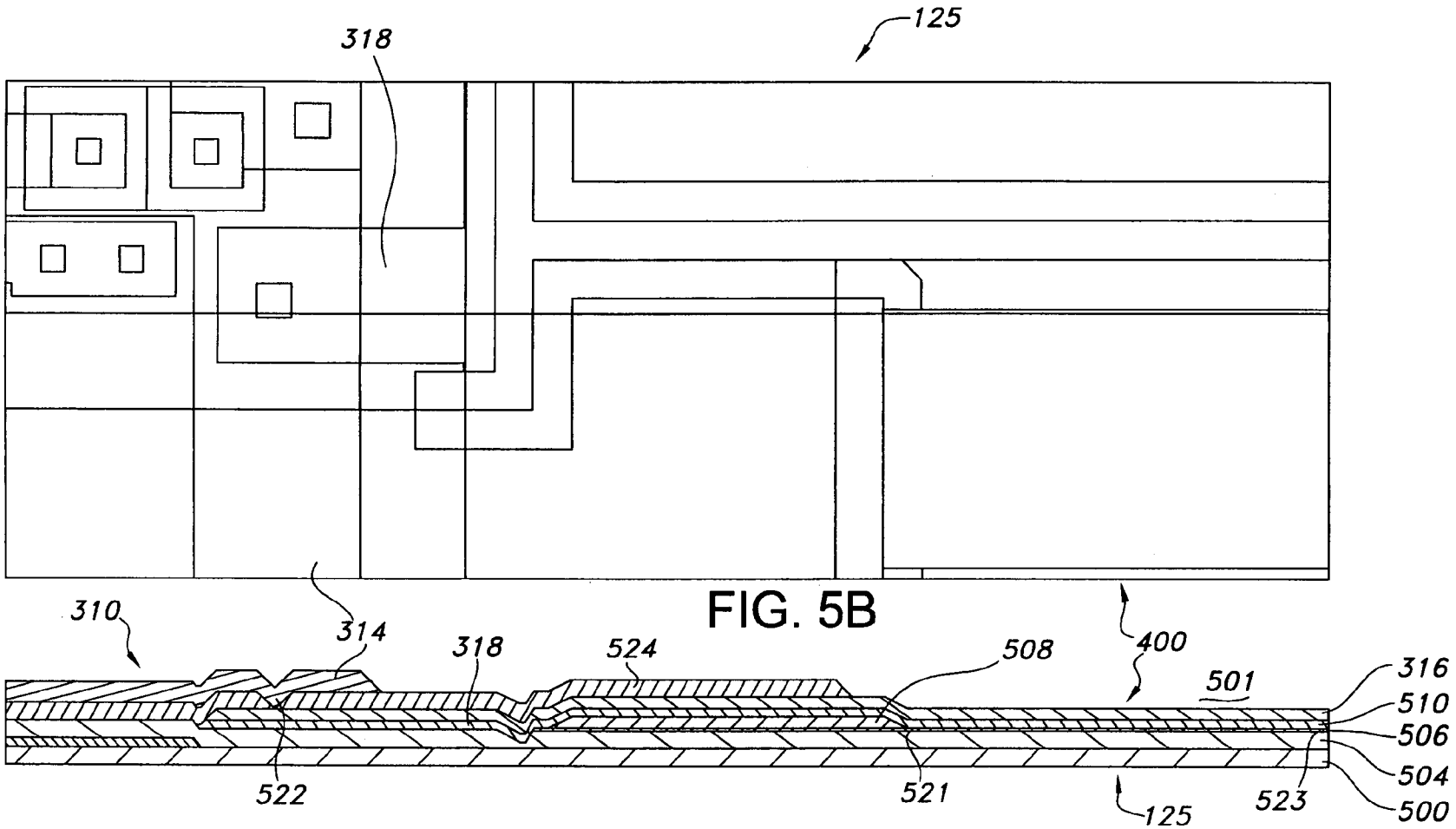
FIGS. 5A and 5B are cross section and an attendant top view in accordance with the teachings of the present invention of the thin film layers of an inkjet printhead heater chip having ESD protection.

Appreciating the heater chip 125 is fabricated as a plurality of thin film layers on a substrate, FIGS. 5A and 5B and their attendant written description are provided to show the over and underlying of various layers relative to one another, especially relative to the ESD circuit 310. The layers are conventionally fabricated through well known processes, such as through a series of growth layers, deposition, masking, patterning, photolithography, and/or etching or other processing steps. Further, FIGS. 5A and 5B are intended to relate to one another similar to engineering drawings whereby transitions from one material to another are aligned relatively vertically in the figures.

In an exemplary embodiment, the thin film layers in the region of the heater 400 include, but are not limited to: a base substrate 500; a field oxide and/or barrier layer 504; a resistor layer 506; a conductor layer 508 (bifurcated into positive and negative electrode sections, i.e., anodes and cathodes with only the single, cathode electrode being shown); a dielectric layer 510; and the cavitation layer 316. In the region of the ESD circuit 310, the substrate supports the ballast resistor 312 and the diode (not shown). The metal buss 314 overlies all layers and connects to the fingers 318 of the cavitation layer 316 by a vertical connection 522 of the metal buss through an intervening insulator layer 524. Ultimately, the ESD circuit 310 is connected to the cavitation layer 316 of the heater 400 and protects the dielectric layer 510 from breakdown during ESD events. In an exemplary embodiment, the ESD circuit 310 provides a safe discharge path for ESD current from the cavitation layer 316 to, for example, ground, for ESD strikes occurring on the cavitation layer. According to an exemplary embodiment, as the electrical connection between a heater and an ESD circuit always exists once the layers are fabricated, ESD protection can be provided during manufacturing, handling and use of the printhead.

With more specificity, the substrate 500 provides the base layer upon which all other layers are formed. In one embodiment, it comprises a silicon wafer of p-type conductivity, 100 orientation, having a resistivity of about 5-20 ohm/cm. Its beginning thickness might, but is not necessarily required, to be any one of 525+/−20 microns, 625+/−20 microns, or 625+/−15 microns, with respective wafer diameters of 100+/−0.50 mm, 125+/−0.50 mm, and 150+/−0.50 mm.

The field oxide layer can be either a grown or deposited layer on the substrate 500, and has a thickness of about 8000 to about 10,000 Angstroms. In one instance, it simply comprises silicon oxide. The barrier layer generally provides thermal protection. Representative embodiments include a silicon oxide layer mixed with a glass or essentially pure glass layers including, but not limited to, BPSG (boron, phosphorous, silicon, glass), PSG (phosphorous, silicon, glass) or PSOG (phosphorous, silicon oxide, glass). An exemplary thickness is about 7800 Angstroms, and this layer can also be grown or deposited. The barrier layer may be combined with the field oxide layer into an essentially contiguous single layer, representatively shown as 504.

Disposed on a surface of the layer 504 is a resistor layer 506 that heats up during use to cause ink to eject from the printhead. The resistor layer 504 can be a tantalum, aluminum, nitrogen mixture having a thickness of about 800 Angstroms. In other embodiments, the resistor layer 504 includes essentially pure or compositions of any of the following: hafnium, Hf, tantalum, Ta, titanium, Ti, tungsten, W, hafnium-diboride, $HfB_2$, Tantalum-nitride, $Ta_2N$, TaAl (N,O), TaAlSi, TaSiC, Ta/TaAl layered resistor, Ti(N,O) and WSi(O). Thicknesses may also range to about 1000 Angstroms or more.

A conductor layer 508 overlies a portion of the resistor layer 506 (e.g., that portion of the resistor layer excluding the portion between points 521 and 523) and includes an anode and cathode for causing the portion of the resistor layer defining the heater 400 to heat up. To stably eject ink, the Applicant incorporates the teaching of co-owned U.S. Pat. No. 6,834,941, entitled "Heater Chip Configuration for an Inkjet Printhead and Printer." In composition and thickness, the conductor layer 508 can be about a 99.5-0.5% aluminum-copper mixture of about 5200 angstroms. In other embodiments, the conductor layer 508 might include pure or compositions of aluminum with 2% copper and aluminum with 4% copper.

On an upper surface portion of the resistor layer 506, as between points 521 and 523, and all along the upper surface of the conductor layer 508, resides a dielectric layer 510 that the ESD circuits 310 protect from breakdown during ESD events. In one embodiment, the dielectric layer 510 comprises diamond-like carbon, including or not dopants such as silicon, nitrogen, titanium, tantalum or the like. The dielectric layer 510 might also comprise conventional materials, such as silicon carbide and/or silicon nitride. The layer 510 can be essentially uniform in thickness and is about 2000 Angstroms. Skilled artisans will appreciate, however, that prior art heater chips often included dielectric layers with thicknesses of 3000 Angstroms or more. Because of the relative thickness of such layers, they did not generally require specialized ESD protection (as compared to dielectric layers on the order of 2000 Angstroms). Thus, the present invention recognizes the problem and provides a simple, but effective solution.

Above the dielectric layer 510 is the cavitation layer 316, which generally exists to help the heater 400 withstand the corrosive effects of ink and/or prevent the long-term bubble collapse effects in the area 501 generally above the heater. In an exemplary embodiment, the cavitation layer 316 includes a layer of tantalum having a thickness of about 2500 Angstroms. In other designs, the cavitation layer 316 might include, for example, undoped diamond-like carbon, pure or doped tantalum, pure or doped titanium or other materials.

A nozzle member, not shown, is eventually attached or formed on the foregoing described heater chip 125 to direct ink drops, formed as bubbles in the ink chamber areas generally above the heaters (e.g. 501), onto a print medium during use.

In the region of the ESD circuit 310, the ballast resistor can be formed from a layer of material having a thickness in a range of about 4,500 to about 11,000 Angstroms. In composition, it can comprise polysilicon deposited on the substrate 500. Alternatively, a ballast resistor can be composed of NWELL, N-Plus, or P-Plus diffusion; a metal or fuse material.

The diode, in one instance, is a PN junction in an NWELL of the substrate or in the bulk substrate. Relative to the ballast resistor, its location can be such that all current that flows through the diode will flow through the ballast resistor. For the NWELL diode, the ballast resistor should be placed on the high side (or upstream to conventional current flow during an ESD event) to make sure all the current flows through the resistor before entering the diode. This might be preferred because an NWELL diode has some parasitic current paths to the substrate that could otherwise adversely affect performance. For a bulk substrate diode embodiment, the ballast resistor should be placed on the low side (or downstream to conventional current flow during an ESD event). This might be preferred because there is often a "sneak" path for current to flow around the ballast resistor if the ballast resistor were placed on the high or other side of the diode.

The metal buss 314 comprises a layer of metal (e.g., the second layer of metal on the heater chip), for example, aluminum-copper, similar to the conductor layer 508. Its thickness is about 11,000 Angstroms, on average. Its width W1 as seen in FIG. 4, for example, is on the order of about 10 micrometers.

For the fingers 318 of the cavitation layer 316, they can embody the same general thickness of the cavitation layer 316, but their other dimensions (length L2×width W2, FIG. 4) might be of the following representative scope: 15 micrometers×7 micrometers.

Still other embodiments of the invention contemplate the thin film layers becoming deposited on the heater chip by any variety of chemical vapor depositions (CVD), physical vapor depositions (PVD), epitaxy, ion beam deposition, evaporation, sputtering or other similarly known techniques. In instances of CVD techniques, embodiments might include low pressure (LP), atmospheric pressure (AP), plasma enhanced (PE), high density plasma (HDP) or other. In etching techniques, embodiments might include, but are not limited to, any variety of wet or dry etches, reactive ion etches, deep reactive ion etches, etc. Photolithography steps include, but are not limited to, exposure to ultraviolet or x-ray light sources, or other, and photomasking includes photomasking islands and/or photomasking holes. The particular embodiment may vary according to manufacturer preference.

Figure 6:
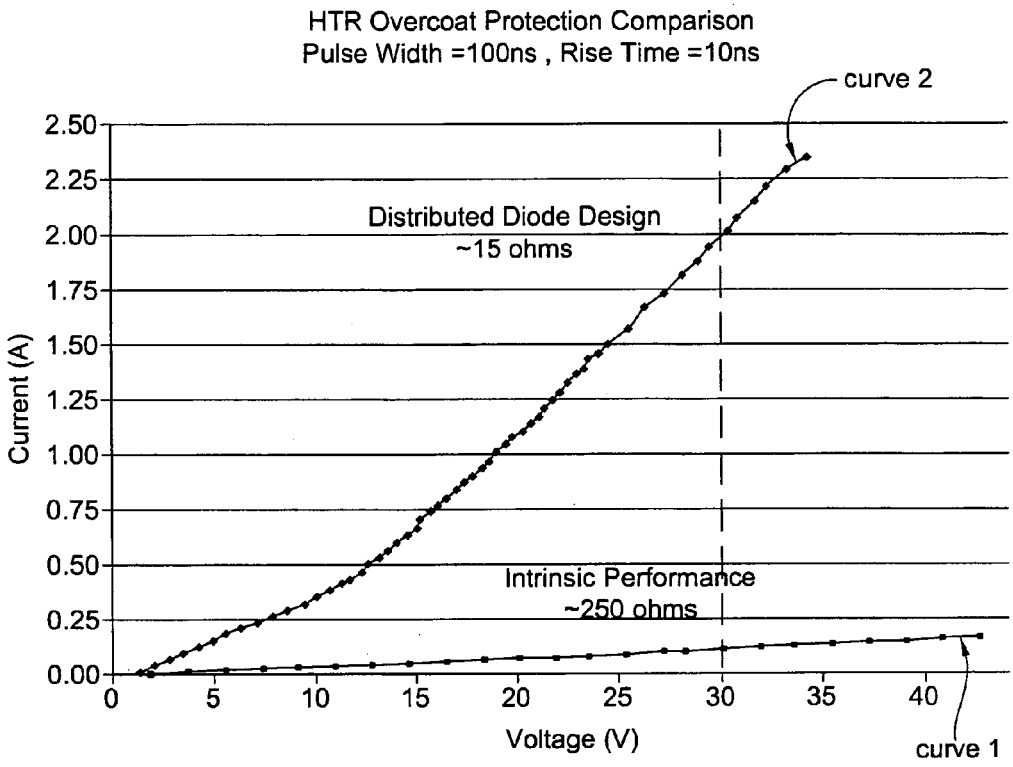
FIG. 6 is a graph in accordance with the teachings of the present invention showing comparisons of the ESD protection provided by an embodiment of the present invention to that provided by a prior art embodiment.

With reference to FIG. 6, a graph plotting the current dissipation effects of a certain prior art design versus that of an embodiment in accordance with the instant invention is shown. In one regard, the prior art design (curve 1) can only dissipate current at less than about 200 milliamps at an ESD voltage of about 30 volts, whereas an embodiment in accordance with the instant invention (curve 2) can dissipate it at about 2 full amps. As skilled artisans will appreciate by comparing this data point and others, an approximate tenfold increase is the result of the instant invention over the prior art regardless of voltage.

Still other test results of various prior art designs versus the instant invention revealed further improvement. For example, an ESD gun for simulating ESD events includes a metal tip that is contacted to heater chips to simulate an ESD voltage strike. In this regard, a full 8 kv is introduced to a chip upon full charging of a gun. With certain prior art designs, however, failure of heater chips were regularly observed with ESD gun discharges on the order of 2 kv. Whereas embodiments in accordance with the instant invention have regularly shown no failure of heater chips, even when the ESD gun discharges a full 8 kv to the chip.

With reference to FIGS. 7A-7C, a column of actuators could have designs alternate to those previously shown and still be embraced within the scope of the invention. For example, FIG. 7A shows actuators 1 through n of a given column 534 existing exclusively along one side 584 of an ink via 80. As seen, a slight horizontal spacing gap S exists between vertically adjacent ones of the actuators, such as about $3/1200^{th}$ of an inch. On the other hand, a vertical distance or pitch P exists between vertically adjacent actuators, such as about $1/300^{th}$, $1/600^{th}$, $1/1200^{th}$, or $1/2400^{th}$ of an inch.

In FIG. 7B, vertically adjacent ones of actuators in column 534 are substantially linearly aligned with one another along an entirety of the length of the ink via 80. Although the actuators of FIGS. 7A, 7B have been shown exclusively on a left side of the via, alternate embodiments of the invention contemplate their location on the right side, or on both sides of the via.

In FIG. 7C, some of the actuator chips of the invention may have more than one ink via and more than one column of actuators, wherein the actuators may be disposed on the same side or on opposite sides of the ink via 80 in columns 534-L and 534-R. In this instance, each column might have a spacing gap S1, S2 between vertically adjacent ones of actuators, such as where both are substantially equal. Also, pitch P may be measured between sequentially numbered actuators such that a twice pitch (2P) vertical spacing exists between sequential odd or even numbered actuators.

Finally, the foregoing description is presented for purposes of illustration and description of the various aspects of the invention. The descriptions are not intended, however, to be exhaustive or to limit the invention to the precise form disclosed. Accordingly, the embodiments described above were chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An inkjet printhead actuator chip, comprising:

dozens of ink actuators substantially arranged in a column to eject ink from said printhead during printing, each of said dozens of ink actuators staggered in relation to adjacent ones of said dozens of ink actuators; and dozens of ESD circuits per each of the dozens of ink actuators, each of said dozens of ESD circuits including a ballast resistor and a diode connected in series, wherein the diode of about half of the dozens of ESD circuits connects in a forward bias toward power while the diode of about the other half of the dozens of ESD circuits connects in a forward bias away from ground, whereby each of said dozens of ESD circuits is substantially equidistantly spaced in relation to a corresponding said each of said dozens of ink actuators to afford substantially common ESD protection.

2. The chip of claim 1, wherein the ballast resistor connects to a metal buss.

3. The chip of claim 1, wherein the ballast resistor comprises polysilicon.

4. The chip of claim 1, wherein the dozens of actuators comprise dozens of heaters, and wherein a cavitation layer overlies a resistor layer.

5. The chip of claim 4, wherein the cavitation layer includes a plurality of fingers connecting to a metal buss.

6. The chip of claim 5, wherein the metal buss connects to the ESD circuit.

7. An inkjet printhead heater chip, comprising:

a substrate;

a plurality of thin film layers on the substrate forming dozens of heaters, each of said dozens of heaters staggered in relation to adjacent ones of said dozens of heaters, the layers including at least a resistor layer on the substrate, a dielectric layer above the resistor layer and a cavitation layer above the dielectric layer;

for two adjacent ones of said dozens of heaters, an ESD circuit per each of said two adjacent ones of said dozens of heaters, wherein every other of said ESD circuits connects to power and a remainder of the ESD circuits connects to ground to protect the dielectric layer from breakdown during an ESD event, whereby each of said ESD circuits is substantially equidistantly spaced in relation to a corresponding said each of said dozens of heaters to afford substantially common ESD protection to the chip.

8. The heater chip of claim 7, wherein the ESD circuit includes a ballast resistor and diode connected in series, and wherein the ballast resistor connects to a metal buss.

9. The heater chip of claim 7, wherein the cavitation layer includes a plurality of fingers connecting to a metal buss.

10. The heater chip of claim 7, wherein the cavitation layer comprises tantalum.

11. The heater chip of claim 7, wherein the ESD circuit includes a diode.

12. The heater chip of claim 11, wherein the diode connects in a forward bias direction toward the power or from the ground.

13. An inkjet printhead chip, comprising:

a plurality of ESD circuits, each of said ESD circuits connecting electrically to power or ground and each of said ESD circuits is approximately equidistantly spaced from an adjacent one of said ESD circuits to increase ESD current dissipation for an entirety of the inkjet printhead chip, wherein every other of said ESD circuits connects to the power and a remainder of said ESD circuits connects to the ground.

* * * * *